US005102451A

United States Patent [19]

Abkowitz et al.

[11] Patent Number: 5,102,451

[45] Date of Patent: Apr. 7, 1992

[54] TITANIUM ALUMINIDE/TITANIUM ALLOY MICROCOMPOSITE MATERIAL

[75] Inventors: Stanley Abkowitz, Lexington; Harold L. Heussi, Essex; Susan M. Abkowitz, Winchester, all of Mass.

[73] Assignee: Dynamet Technology, Inc., Burlington, Mass.

[21] Appl. No.: 610,572

[22] Filed: Nov. 8, 1990

[51] Int. Cl.[5] ..... B22F 9/00

[52] U.S. Cl. ..... 75/245; 420/417; 420/418; 428/457; 428/689

[58] Field of Search ..... 75/245; 420/417, 418; 428/457, 689

[56] References Cited

U.S. PATENT DOCUMENTS 4,879,092 11/1989 Huang ..... 75/245 X
4,897,127 1/1990 Huang ..... 75/245 X
4,927,458 5/1990 Blackburn et al. ..... 75/245 X
4,990,181 2/1991 Pierotti et al. ..... 75/245 X

*Primary Examiner*—Stephen J. Lechert, Jr.
*Assistant Examiner*—Leon Nigohosian, Jr.
*Attorney, Agent, or Firm*—Finnegan, Henderson, Farabow, Garrett & Dunner

[57] ABSTRACT

A titanium-based microcomposite material includes first and second constituents. The first constituent is titanium or a titanium-based alloy. The second constituent is about 1% to about 50% by volume titanium aluminide. The microstructure of the microcomposite material includes smaller portions of titanium aluminide uniformly distributed among larger portions of titanium or a titanium-based alloy. The microcomposite material has improved elevated temperature properties and an increased strength-to-weight ratio.

14 Claims, 1 Drawing Sheet

TITANIUM ALUMINIDE/TITANIUM ALLOY MICROCOMPOSITE MATERIAL

FIELD OF THE INVENTION

The present invention relates to powder metallurgy and, more particularly, to a titanium aluminide/titanium alloy microcomposite material.

BACKGROUND OF THE INVENTION

Titanium-based alloys offer a combination of properties up to moderately elevated temperatures including strength, toughness, low density, and corrosion resistance. Titanium-based alloys consequently have been extensively used in aerospace applications as a weight-saving replacement for iron and nickel-based alloys in components that operate at low to moderately elevated temperatures.

The assignee of the present application has been extensively involved in efforts to improve the properties of titanium-based alloys to broaden the scope of applications where these alloys can be utilized. For example, U.S. Pat. No. 4,731,115 to Abkowitz et al. discloses a microcomposite material in which TiC is incorporated in a titanium-based alloy matrix as a reinforcement or stiffening material by adding TiC powder to powder having a composition disposed to form a titanium-based alloy matrix. Upon being compacted and sintered at a temperature selected to preclude diffusion of the TiC into the matrix, the composite material exhibits higher hardness, higher modulus, and better wear resistance than the titanium-based alloy matrix material.

U.S. Pat. Nos. 4,906,430 and 4,968,348 to Abkowitz et al. disclose a microcomposite material in which $TiB_2$ is incorporated a titanium-based alloy matrix as a reinforcement material. The microcomposite material formed by the addition of $TiB_2$ has increased strength and modulus in comparison with the microcomposite material formed by the addition of TiC.

During the course of continuing developmental work, the present inventors have discovered a reinforcement or stiffening material for titanium and titanium-based alloys that yields a microcomposite material having improved modulus and elevated temperature tensile strength, while retaining reasonable ductility and with a lower overall density than existing titanium-based alloys.

Accordingly, it is an object of the present invention to provide a titanium-based microcomposite material having improved mechanical properties including modulus, elevated temperature tensile strength, and strength-to-weight ratio.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

To achieve the foregoing objects and in accordance with the purpose of the invention, as embodied and broadly described herein, the present invention is a titanium-based microcomposite material including first and second constituents. The first constituent is comprised of titanium or a titanium-based alloy. The second constituent is comprised of titanium aluminide. The microcomposite material contains about 1% to about 50% by volume titanium aluminide and has a microstructure comprised of smaller portions of titanium aluminide uniformly distributed among larger portions of titanium or the titanium-based alloy. In a preferred embodiment, the microcomposite material contains about 10% by weight titanium aluminide.

The microcomposite material is preferably formed by blending powder titanium aluminide and powder titanium or a powder titanium-based alloy mixture to form a blend containing about 1% to about 50% by volume titanium aluminide, cold isostatically pressing the blend to form a green compact, and sintering the green compact to form a sintered article. In preferred embodiments, the sintered article is hot extruded, hot forged, or hot isostatically pressed to further densify the article.

BRIEF DESCRIPTION OF THE DRAWINGS

The accompanying drawings, which are incorporated in and constitute a part of this specification, illustrate an embodiment of the invention and, together with the description, explain the principles of the invention.

DESCRIPTION OF THE PREFERRED EMBODIMENTS

Reference will now be made in detail to the present preferred embodiments of the invention, examples of which are illustrated in the accompanying drawings.

The present invention is a titanium-based microcomposite material including first and second constituents. In accordance with the invention, the first constituent is comprised of a material selected from the group consisting of titanium and titanium-based alloys. The first constituent material is preferably powder metal having a particle size in the range from about 50 to about 150 microns. Suitable titanium-based alloys for the first constituent include, but are not limited to, Ti-6Al-4V, Ti-6Al-6V-2Sn, Ti-6Al-2Sn-4Zr-2Mo, Ti-10V-2Fe-3Al, and Ti-5Al-2.5Sn.

In accordance with the invention, the second constituent is comprised of titanium aluminide. Titanium aluminide is an intermetallic compound that exists in two forms: TiAl (gamma) and $Ti_3Al$ (alpha). TiAl is the preferred form of titanium aluminide because of its lower density and higher temperature resistance. In accordance with the invention, about 1% to about 50% by volume titanium aluminide is incorporated in the first constituent as a reinforcement or stiffening material. In a preferred embodiment, about 5% to about 20% by volume titanium aluminide is incorporated in the first constituent. In another preferred embodiment, about 5% to about 20% by volume TiAl is incorporated in the first constituent.

Titanium aluminide may be uniformly incorporated in the first constituent by blending powder titanium aluminide into the powder metal forming the first constituent. The powder titanium aluminide preferably has a particle size in the range of from about 20 to about 100 microns.

The blended powder titanium aluminide and powder titanium or titanium-based alloy particles may be disposed in a mold and cold isostatically pressed to form a green compact using conventional powder metallurgy techniques. The compact is then sintered to form a sintered article. The compact preferably is vacuum sintered at a temperature selected to preclude significant reaction of titanium aluminide with the surrounding first constituent material. The sintering temperature and time is preferably in the range of from about 2200° F. to about 2250° F. for about 2-3 hours. If desired, the sintered article may be further densified by hot extrusion, hot forging, or hot isostatic pressing.

Figure 1:
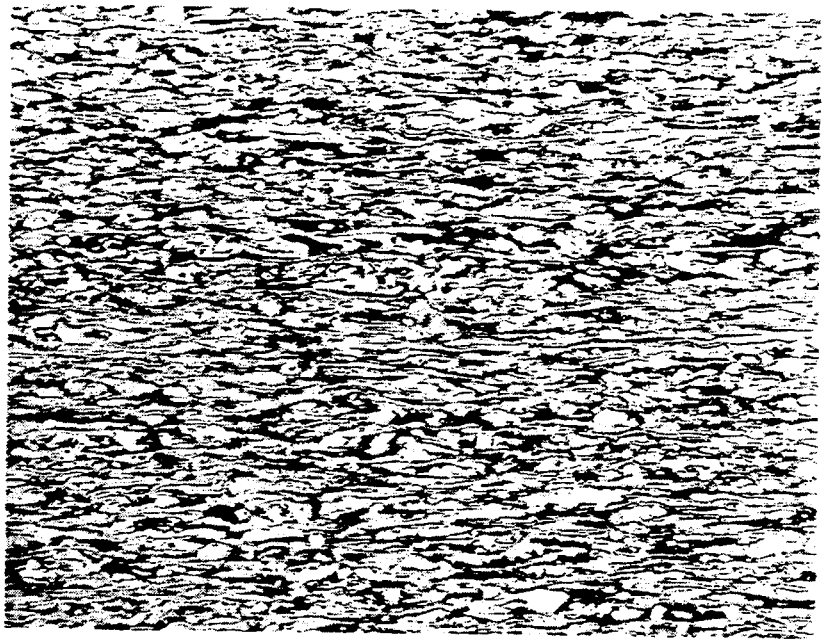
FIG. 1 is a 100×photomicrograph of an extruded article of Ti-6Al-4V having 10% by weight TiAl distribution therein.
Figure 2:
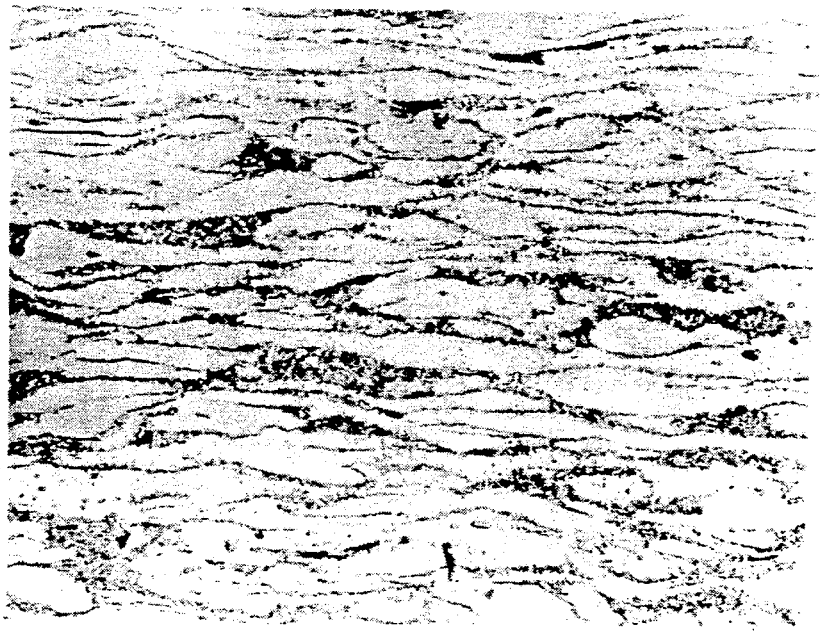
FIG. 2 is a 500×photomicrograph of the microstructure of the microcomposite material of FIG. 1.

FIG. 1 is a 100×photomicrograph of an extruded article of Ti-6Al-4V having 10% by weight TiAl distributed therein. FIG. 2 is a 500×photomicrograph of the microstructure of the microcomposite material of FIG. 1. The microstructure is comprised of smaller portions of titanium aluminide, which are the darker portions in FIGS. 1 and 2, uniformly distributed among larger portions of Ti-6Al-4V alloy, which are the lighter portions in FIGS. 1 and 2. The titanium aluminide portions of the microstructure are believed to be TiAl but may also include $Ti_3Al$ formed as the result of reaction with Ti-6Al-4V alloy.

The mechanical properties of the microcomposite material containing 10% by weight TiAl in Ti-6Al-4V alloy are shown below in Table I. The samples were prepared by blending amounts of powder TiAl and powder Ti-6Al-4V alloy to form a blend containing 10% by weight TiAl. The blend was cold isostatically pressed at about 55,000 psi to form a green compact. The green compact was vacuum sintered at about 2200°-2250° F. for 2-3 hours and furnace cooled to form a sintered article. The sintered article then was subjected to hot extrusion in a mild steel can at about 1700° F.

TABLE I

| | Sample A | Sample B |
|---|---|---|
| Ultimate Tensile Strength at Room Temperature (ksi) | 187.2 | 185.5 |
| 0.2% Offset Yield Strength (ksi) | 184.6 | 182.1 |
| Elongation (%) | 2.3 | 1.8 |
| Reduction of Area (%) | 7.3 | 5.2 |

The elevated temperature properties (at 1000° F.) of the microcomposite material containing 10% by weight TiAl in Ti-6Al-4V alloy are shown in Table II. The sample was prepared in the manner described above for the samples listed in Table I.

TABLE II

| | Sample C |
|---|---|
| Ultimate Tensile Strength at 1000° F. (ksi) | 75.4 |
| 0.2% Offset Yield Strength (ksi) | 68.3 |
| Elongation (%) | 2.0 |
| Reduction of Area (%) | 6.9 |
| Young's Modulus $\times 10^6$ psi | 13.9 |

The ultimate tensile strength and Young's modulus at 1000° F. for a Ti-6Al-4V alloy sample prepared by cold isostatic pressing, vacuum sintering, and hot isostatic pressing are on the order of 65,000 psi and $11.3\times10^6$ psi, respectively. As can be seen in Table II, the microcomposite material formed by the addition of TiAl has increased elevated temperature strength and modulus in comparison with Ti-6Al-4V alloy. The microcomposite material also has retained reasonable elevated temperature ductility properties. A further benefit of the addition of TiAl is that the overall density of the microcomposite material is less than the density of Ti-6Al-4V alloy. Thus, the microcomposite material has increased specific strength and increased specific modulus, which reflects an increased strength-to-weight ratio.

The present invention has been disclosed in terms of preferred embodiments. The invention is not limited thereto and is defined by the appended claims and their equivalents.

What is claimed is:

1. A titanium-based microcomposite material comprised of a first constituent, said first constituent being comprised of a material selected from the group consisting of titanium and titanium-based alloys, and about 1% to about 50% by volume of a second constituent, said second constituent being comprised of titanium aluminide, said microcomposite material having a microstructure comprised of smaller portions of said second constituent uniformly distributed among larger portions of said first constituent.

2. The titanium-based microcomposite material of claim 1, wherein said second constituent is comprised of TiAl.

3. The titanium-based microcomposite material of claim 1, wherein said second constituent consists essentially of TiAl.

4. The titanium-based microcomposite material of claim 1, wherein said material contains about 5% to about 20% by volume titanium aluminide.

5. The titanium-based microcomposite material of claim 3, wherein said material contains about 5% to about 20% by volume TiAl.

6. The titanium-based microcomposite material of claim 1, wherein said material contains about 10% by volume TiAl.

7. The titanium-based microcomposite material of claim 1, wherein said first constituent is comprised of a titanium-based alloy selected from the group consisting of Ti-6Al-4V, Ti-6Al-6V-2Sn, Ti-6Al-2Sn-4Zr-2Mo, Ti-10V-2Fe-3Al, and Ti-5Al-2.5Sn.

8. The titanium-based microcomposite material of claim 1, wherein said first and second constituents are in powder form, and said second constituent is incorporated in said first constituent by blending.

9. A titanium-based microcomposite material comprised of a first constituent, said first constituent being comprised of Ti-6Al-4V, and about 10% by weight of a second constituent, said second constituent being comprised of TiAl, said material having a microstructure comprised of smaller portions of titanium aluminide uniformly distributed among larger portions of Ti-6Al-4V, said material having a tensile strength of at least approximately 70,000 psi at about 1000° F.

10. The titanium-based microcomposite material of claim 9, wherein said second constituent is comprised of TiAl.

11. A sintered, titanium-based microcomposite article, said article being formed by a method comprising the steps of:

providing an amount of a first powder metal constituent, said first constituent being comprised of a material selected from the group consisting of titanium and titanium-based alloys;

providing an amount of a second powder metal constituent, said second constituent being comprised of titanium aluminide;

blending amounts of said first and second constituents to form a blend containing about 1% to about 50% by volume titanium aluminide;

cold isostatically pressing said blend to form a green compact; and sintering said green compact to form said sintered article.

12. The sintered, titanium-based microcomposite article of claim 11, wherein said method further comprises the step of:

hot isostatically pressing said sintered article.

13. The sintered, titanium-based microcomposite article of claim 11, wherein said method further comprises the step of:

hot extruding said sintered article.

14. The sintered, titanium-based microcomposite article of claim 11, wherein said method further comprises the step of:

hot forging said sintered article.

* * * * *